US005316653A

United States Patent [19]

Wu et al.

[11] Patent Number: 5,316,653

[45] Date of Patent: May 31, 1994

[54] MINIMIZATION OF MOUNDS IN IRON-ZINC ELECTROGALVANIZED SHEET

[75] Inventors: Chyang J. Wu, Monroeville; Jack E. Manack, Murrysville, both of Pa.

[73] Assignee: USX Corporation, Pittsburgh, Pa.

[21] Appl. No.: 922,994

[22] Filed: Jul. 30, 1992

[51] Int. Cl.[5] ..... C25D 3/56

[52] U.S. Cl. ..... 205/245; 106/1.29

[58] Field of Search ..... 205/245; 106/1.29

[56] References Cited

U.S. PATENT DOCUMENTS 2,778,787 1/1957 Salt et al. ..... 205/245
4,540,472 9/1985 Johnson et al. ..... 205/245
4,541,903 9/1985 Kyono et al. ..... 205/245

FOREIGN PATENT DOCUMENTS 211594 5/1983 Japan .

OTHER PUBLICATIONS

Irie et al., "Development of Zn-Fe Alloy Electroplating with Soluble Anode in Chloride Bath", 4th AES Continuous Strip Plating Symposium, Chicago, IL, May 13, 1984.

*Primary Examiner*—John Niebling
*Assistant Examiner*—Kishor Mayckar
*Attorney, Agent, or Firm*—W. F. Riesmeyer, III; J. R. Pegan

[57] ABSTRACT

A process and electrolyte for forming mound-free coatings of zinc-iron alloy on metal, e.g. steel, sheet and strip comprises passing the article to be plated through an electrolyte bath containing chlorides of iron and zinc and from about 2 to about 6 g/l, and particularly about 2.5 to about 3.5 g/l, of citric acid.

6 Claims, 3 Drawing Sheets

MINIMIZATION OF MOUNDS IN IRON-ZINC ELECTROGALVANIZED SHEET

BACKGROUND OF THE INVENTION

1. Field of the Invention

This invention relates to iron-zinc electrogalvanized metal sheet and strip, and particularly to improved methods and electrolytes for providing electrogalvanized steel sheets and strip having enhanced surface smoothness essentially free of "mounds" caused by metal oxides occluded in the electrodeposited metal coating.

2. Description of Related Art

Manufacture of lustrous iron-zinc electrodeposited coatings on metal substrates is described in Salt, U.S. Pat. No. 2,778,787. In that patent, such deposits are obtained from an electrolyte bath containing chlorides of iron, zinc, ammonia and potassium and, for example, 0.5 g/l of citric acid which furnishes ferric ion with a chelate group, thereby preventing precipitation of ferric hydroxide from the bath.

In an article entitled "Development of Zn-Fe Alloy Electroplating With Soluble Anode in Chloride Bath," 4th AES Continuous Strip Plating Symposium, Chicago, Ill., May 13, 1984, Irie et al. describe a similar process using soluble anodes and with addition of citric acid (amount not specified) to prevent precipitation of ferric hydroxide from an electrolyte bath containing chlorides of iron, zinc and ammonia.

Japanese published application No. 59/211594 discloses the production of Zn-Fe electroplated steel sheets wherein the deposited coating contains 7–35 weight percent Fe and is chemically single-phase. Examples of electrolyte baths contain chlorides of iron, zinc, ammonia and either ammonium citrate, 5 g/l, or citric acid, 2 g/l, together with sodium acetate, 10 g/l, and wherein plating was performed at 50° C. (122° F.) and a pH of 3.

U.S. Pat. No. 4,540,472 discloses the electrodeposition of Zn-Fe alloy coatings from an electrolyte bath containing chlorides of zinc, iron and potassium, together with an amount of sulfate ion, an adduct such as a polyethylene glycol, and a chelating agent such as citric acid in an amount from 0.5 g/l to 5 g/l.

SUMMARY OF THE INVENTION

This invention provides a method of electroplating elongated metal articles, such as steel sheet or strip, with a zinc-iron alloy coating, comprising passing the article to be plated through a chloride-containing electrolyte bath comprising a source of iron and zinc ions and from about 2 to 6 g/l, preferably about 2 to 3.5 g/l, and especially about 2 or 2.5 to about 3 g/l of citric acid.

In another aspect, the invention relates to an improved bath for the electrodeposition of zinc-iron coatings comprising a chloride-containing solution comprising iron and zinc ions and from about 2 to 6 g/l, preferably about 2.5 to 3.5, and especially about 2.5 to about 3 g/l of citric acid, without other chelating or reducing agents. The electrolyte bath may contain a grain refining agent, such as a polyethylene glycol.

DESCRIPTION OF THE PREFERRED EMBODIMENTS

Zinc-iron electroplated steel sheets are useful, e.g. in the fabrication of appliances and automobile body parts, such as hoods, where the appearance of the painted sheet is very important.

Recently, a "stoning" test has been adopted in which coated sheets are subjected to rubbing with a slightly abrasive stone, whereby any surface projections are made readily apparent. These projections, called "mounds," are slight but sufficiently great to cause concern as to their effect on appearance of the finished painted sheet metal. Such tiny, raised portions of the surface of the coating can slightly dent the sheet or strip as it passes over rolls, causing high spots on the opposite side of the metal sheet or strip, particularly on lighter metal gauges.

Therefore it is an object of the present invention to provide method and means for minimizing production of mounds on zinc-iron electrogalvanized rolled metal articles such as steel sheet and strip.

It is known that citric acid serves as a chelating agent for ferric ion in chloride-containing electrolyte solutions for electroplating zinc-iron alloy coatings. As such, citric acid inhibits the precipitation of ferric hydroxide, and thus prevents increase in concentration of the undissolved solid contents of the electrolyte.

Investigation by the present inventors, however, has shown that such precipitated ferric hydroxide, which occurs in the form of extremely fine particles, is not the source or the principle source of mounds. Efforts to produce mounds from solutions containing high proportions of precipitated iron hydroxide particles were unsuccessful. Instead, such undesirable accompaniment to the electrodeposition of zinc-iron alloy coatings from an electrolyte solution containing chlorides of iron and zinc, has now been found to be primarily due to iron oxide scale from the soluble iron anodes used in such process. Such iron anode particles are substantially larger than the particles of precipitated ferric hydroxide, but are not effectively and consistently removed from the electrolyte by filtering.

Further, the inventors have found that scaling of such large size particles from the iron anodes can be prevented or substantially reduced, so that mounds are not formed, by strictly controlling the amount of citric acid in the electrolyte such that the total maximum solids in the electrolyte is about 0.5 g/l. Thus it has been found that a minimum of 2 grams/liter, and preferably at least 2.5 g/l, of citric acid is required for this purpose. Below that amount of citric acid, there is insufficient inhibition of iron anode scale formation to prevent or to substantially reduce the formation of mounds. For such purposes, citric acid may be used in maximum amount up to about 5 or 6 g/l., resulting in low concentrations of total suspended solids in the electrolyte.

Figure 1:
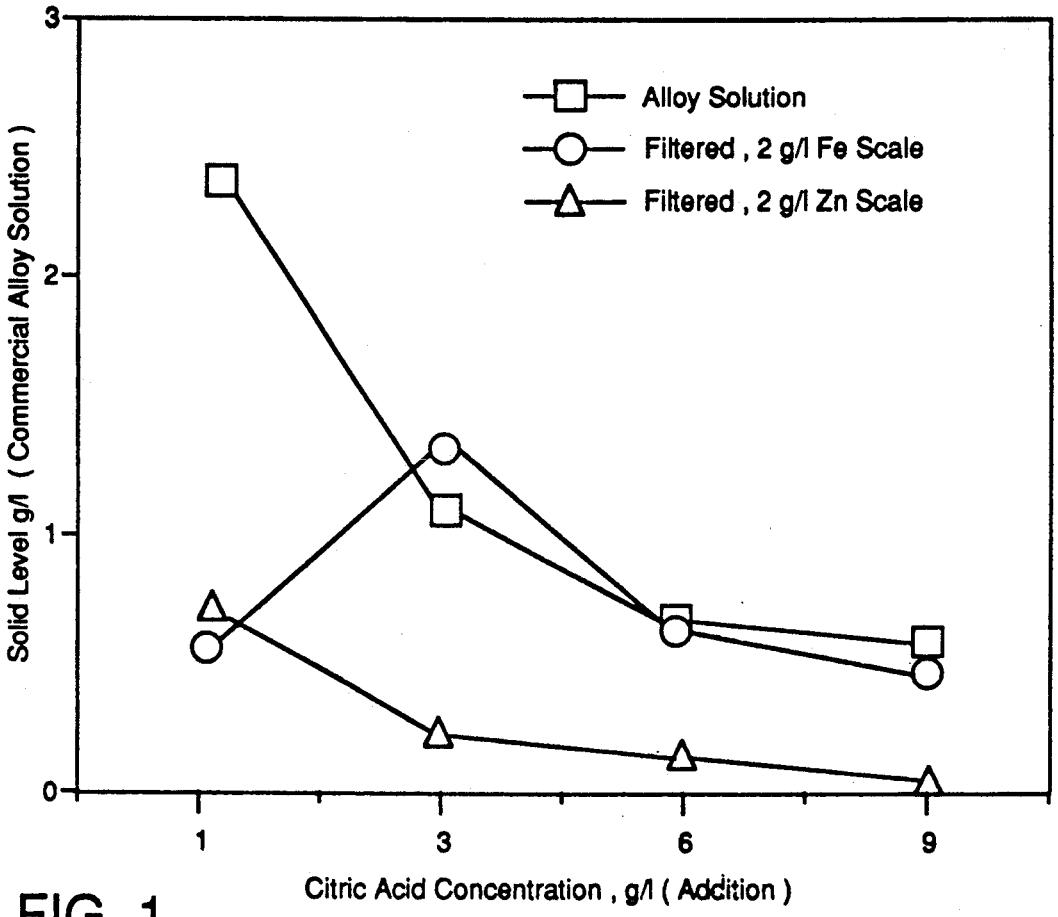
FIG. 1 is a graph relating citric acid concentration to amount of solids in the electrolyte, for a commercial electrolyte solution and for filtered solutions to which known amounts of, respectively, iron scale and zinc scale are added.

Reference to FIG. 1 shows that the solids level in the electrolyte falls with increasing citric acid content, up to a level of about 5 or 6 g/l, at which point the solids vs. citric acid concentration curves level off and become substantially constant. An exception is the laboratory-made electrolyte containing added zinc anode scale, in which increasing citric acid concentration has no solids lowering effect up to about 6 g/l of citric acid. However, it also is seem f rom FIG. 1 that, in the filtered alloy solution containing 2 g/l of iron oxide scale, increasing citric acid content to about 2 g/l to 2.5 g/l lowers iron scale to about 0.5 g/l, and 3 g/l of citric acid results in lowering iron scale well below 0.5 g/l. From the same Fig. it is seen that about 6 g/l of citric acid is required to reduce total solids content of a commercial electrolyte (including precipitated ferric hydroxide and anode scales) to about 0.5 g/l.

Figure 2:
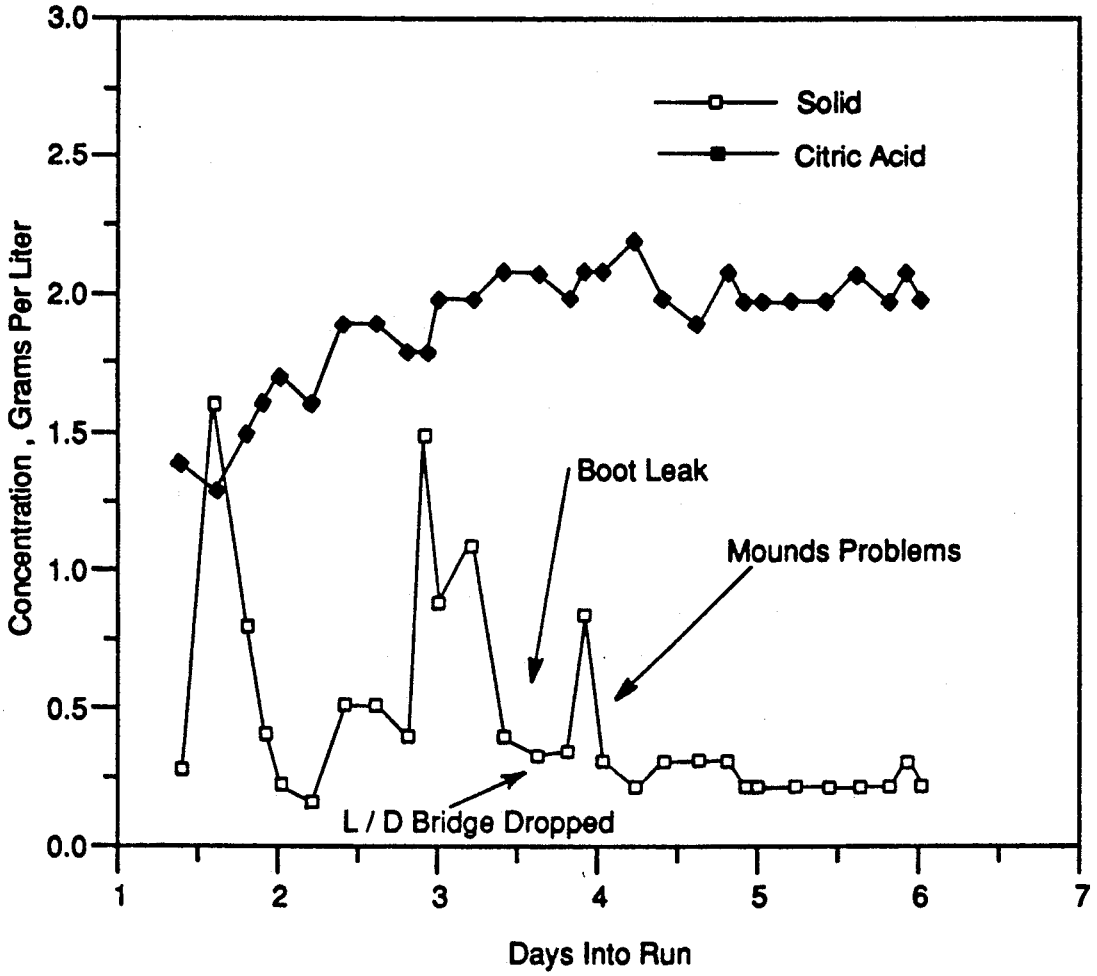
FIGS. 2 and 3 are graphs relating citric acid concentration and solids content in the electrolyte versus running time for a commercial eletroplating operation.
Figure 3:
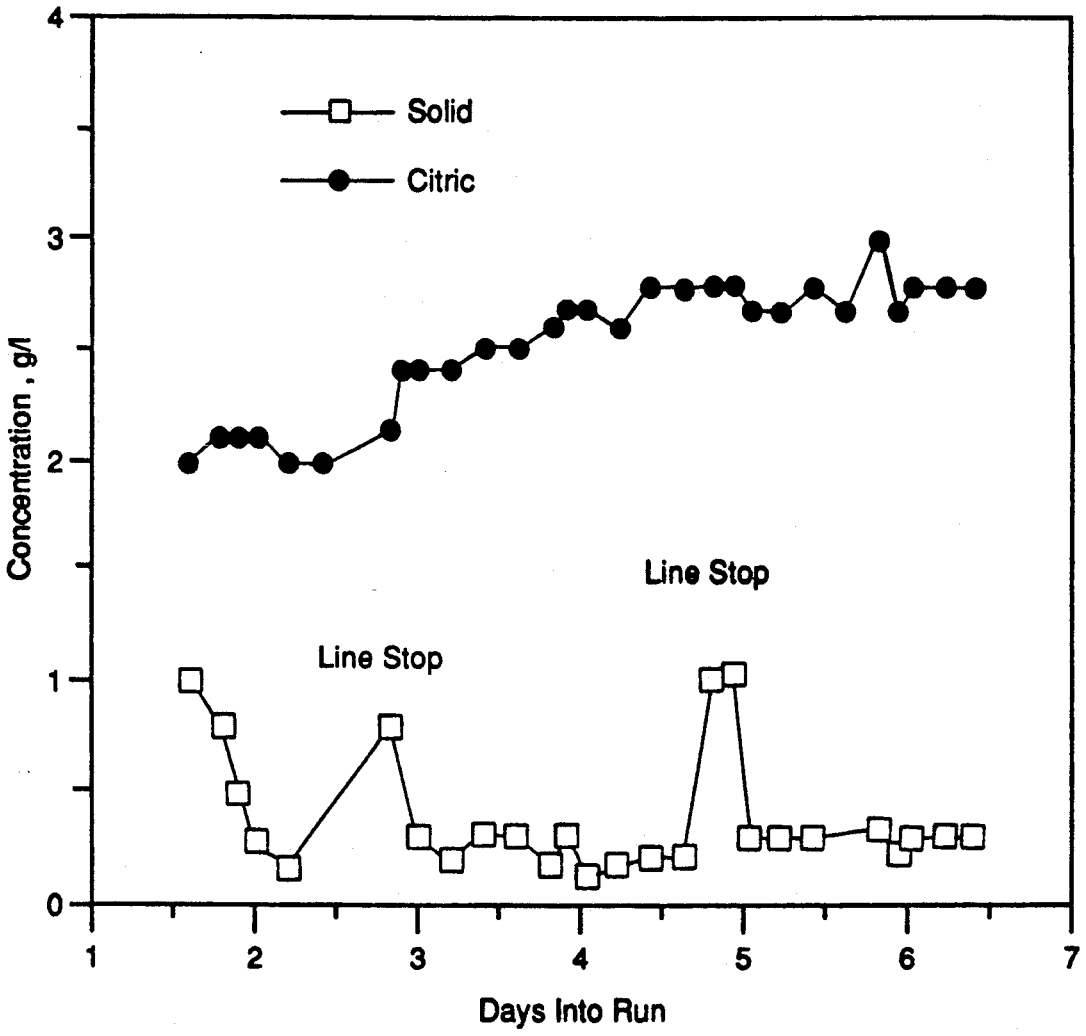

The beneficial effect of controlled citric acid content also is shown by the graphs of FIG. 2. At citric acid concentration below about 2, solids content of the electrolyte varies within wide limits and mounds are found in the deposited coating. However, when citric acid content is raised to about 2 to 2.3 g/l, solids content becomes substantially constant at a low level of about 0.25–0.3 g/l and mound formation is substantially eliminated.

Increase in citric acid concentration of the electrolyte is accompanied by some decrease in plating efficiency, and decrease in solids content, particularly iron anode scale, is not great over a citric acid concentration of about 3 to 3.5 g/l. Moreover, increased amounts of citric acid increase the cost of the electrolyte. Therefore, we prefer to limit the upper level of citric acid to a concentration of about 3.5, especially about 3, in the electrolyte baths of the invention.

Substantially mound-free coatings can be produced in accordance with the invention in a process operated at a pH of 3 to 3.5, a temperature of about 125° F. and at line speeds up to 700 fpm. The products so produced are lustrous, highly corrosion-resistant and of good adherence to the metal substrate.

What is claimed is:

1. A method of producing on an elongated steel sheet or strip base a substantially mound-free electroplated coating of zinc-iron alloy from an electrolyte bath comprising chloride ions and a soluble anode source of iron and zinc ions, which method comprises substantially preventing scaling or iron oxide particles from the iron-containing anode and maintaining a maximum amount of total solids in the bath at about 0.5 grams per liter of the bath during electroplating of the coating by adding to the bath citric acid in an amount from about 2 grams per liter to about 6 grams per liter of bath solution.

2. A method according to claim 1, wherein the citric acid content is about 2 to about 3.5 g/l.

3. A method according to claim 1, wherein the citric acid content is 2 to about 3 g/l.

4. A method according to claim 1, wherein the citric acid content is 2.5 to about 3 g/l.

5. An improved electrolyte bath for electrodepositing substantially mound-free zinc-iron coatings, said bath consisting essentially of a chloride-containing solution of zinc and iron ions, a grain refining agent, and citric acid in an amount from about 2 to about 3.5 g/l of the electrolyte bath.

6. A bath according to claim 5, wherein the citric acid content of the bath is from about 2.5 to about 3.5 g/l.

* * * * *